US006896545B2

(12) United States Patent
Suess et al.

(10) Patent No.: US 6,896,545 B2
(45) Date of Patent: May 24, 2005

(54) JACK FOR A PLUG-JACK COMBINATION HAVING A JACK CONTACT WITH A DEFORMING CONTACT PART

(75) Inventors: Mario Suess, Bamberg (DE); Roland Kuhn, Weisbrunn (DE); Markus Dorscht, Geisfeld (DE)

(73) Assignee: Wieland Electric GmbH, Bamberg (DE)

( * ) Notice: Subject to any disclaimer, the term of this patent is extended or adjusted under 35 U.S.C. 154(b) by 0 days.

(21) Appl. No.: 10/360,650

(22) Filed: Feb. 10, 2003

(65) Prior Publication Data

US 2003/0176115 A1 Sep. 18, 2003

Related U.S. Application Data

(63) Continuation of application No. PCT/EP01/09149, filed on Aug. 8, 2001.

(30) Foreign Application Priority Data

Aug. 10, 2000 (DE) ..... 100 39 862

(51) Int. Cl.[7] ..... H01R 13/52
(52) U.S. Cl. ..... 439/521; 439/843
(58) Field of Search ..... 439/521, 843–846

(56) References Cited

U.S. PATENT DOCUMENTS

| | | | | | |
|---|---|---|---|---|---|
| 4,002,400 | A | | 1/1977 | Evans | 439/748 |
| 4,186,986 | A | * | 2/1980 | Shoemaker | 439/204 |
| 4,412,717 | A | * | 11/1983 | Monroe | 439/582 |
| 4,685,761 | A | | 8/1987 | Locati | 439/843 |
| 4,786,262 | A | * | 11/1988 | Molitor et al. | 439/843 |
| 5,088,942 | A | | 2/1992 | Welsh et al. | 439/843 |
| 5,106,328 | A | * | 4/1992 | Prochaska et al. | 439/751 |
| 5,332,394 | A | * | 7/1994 | Frost | 439/125 |
| 5,486,120 | A | * | 1/1996 | McMills et al. | 439/521 |
| 6,042,432 | A | * | 3/2000 | Hashizawa et al. | 439/843 |
| 6,068,498 | A | * | 5/2000 | Strack | 439/181 |

FOREIGN PATENT DOCUMENTS

| | | | |
|---|---|---|---|
| CH | 579 830 | | 9/1976 |
| DD | 67 484 | | 6/1969 |
| DE | 317 343 | | 6/1917 |
| DE | 3800043 | * | 7/1989 |
| DE | 197 22 543 C1 | | 10/1998 |

* cited by examiner

*Primary Examiner*—Michael C. Zarroli
(74) *Attorney, Agent, or Firm*—Sughrue Mion, PLLC

(57) ABSTRACT

A jack for a plug-jack combination, having a spark protection sleeve (12) and a jack contact (1) fixed in the spark protection sleeve (12). The jack contact (1) is pretensioned solely by an elastic, reversible deformation of its contact elements in the final, assembled state. The contact elements from a contact part (6) that preferable establishes a press fit fixing the jack contact to the spark protection sleeve.

22 Claims, 4 Drawing Sheets

JACK FOR A PLUG-JACK COMBINATION HAVING A JACK CONTACT WITH A DEFORMING CONTACT PART

This is a Continuation of International Application PCT/EP01/09149, with an international filing date of Aug. 8, 2001, which was published under PCT Article 21(2) in German, and the disclosure of which is incorporated into this application by reference.

FIELD OF AND BACKGROUND OF THE INVENTION

The present invention relates to a jack for a plug-jack combination. More particularly, the invention relates to such a jack having a spark protection sleeve and a jack contact. Such a plug-jack combination is known, for example, from German Patent DE-C 197 22 543 (which corresponds to U.S. Pat. No. 6,068,498 to Strack). There, a jack is illustrated in which a spark protection sleeve is pushed onto a jack contact. The spark protection sleeve is plastically deformed in order to implement a form-fitting seat on the jack. In addition, the contact lamellae forming the contact part of the jack contact are bent inward in order to produce a certain pretensioning of the jack.

The large forces which must be applied to deform the spark protection sleeve and to deform the contact lamellae are burdensome and disadvantageous in the production process. Specifically, the jack, in its final fabricated state, can easily suffer from alignment errors of the actual insertion opening, or the contact opening, on the contact part of the jack contact in relation to the introduction opening on the spark protection sleeve.

With respect, in particular, to the form fit that connects the spark protection sleeve and the jack contact, produced by deforming the spark protection sleeve, this means that typically the spark protection sleeve is pressed in, flattened and/or mortised at four diametrically opposing points, in order, thereby, to clinch a part of the spark protection sleeve with the jack contact. A ring groove may be provided in the jack contact for this purpose, into which the deformed regions of the spark protection sleeve then engage like barbs. This deformation of the spark protection sleeve, and the large forces associated with this deformation, can, however, give rise to alignment errors between the spark protection sleeve and the jack contact.

Further, with respect to the contact lamellae, in the extreme case, this conventional approach can lead to a situation where one contact lamella is not deformed or flattened at all while the other contact lamellae are so greatly deformed that they project into the insertion opening of the spark protection sleeve. Specifically, they are bent into the insertion opening to such an extreme that a plug pin runs into the front edges of the inwardly projecting contact lamellae as the plug pin is inserted into the opening of the spark protection sleeve, and thereby destroys the lamellae and/or pushes the jack contact out of the housing of the jack.

Finally, GDR Patent 67 484 discloses a contact sleeve having a laminar spring, in which the laminar spring is fixed flush in a sleeve using two ribs. This arrangement is disadvantageous, however, due to the high dimensional precision required in the region of the planar surfaces that are formed by the ribs and the adjoining regions of the sleeve.

OBJECTS OF THE INVENTION

In view of these problems and deficiencies in the conventional art, the present invention has a primary object of designing a jack in such a way that alignment errors may be avoided to a much greater degree than heretofore.

SUMMARY OF THE INVENTION

According to one formulation of the invention, this and other objects are solved by designing the spark protection sleeve and jack contact to exhibit a reversible deformation when the two parts are joined together. In particular, according to this formulation, the invention provides an improvement whereby the contact part on the jack is deformed reversibly in relation to the spark protection sleeve.

It is advantageous to mount the jack contact in the spark protection sleeve using a press fit. In this way, the jack contact must only be pressed into the spark protection sleeve. Therefore, no deformation forces act on the spark protection sleeve. Furthermore, the jack contact is pressed into the spark protection sleeve in the direction of the central longitudinal axis of the jack contact, which is essentially congruent with the central longitudinal axis of the spark protection sleeve in the final, assembled state, so that alignment errors are avoided.

By designing the connection of the jack contact in the spark protection sleeve as a press fit additionally has the advantage that the jack contact may be inserted into the spark protection sleeve and fixed using the press fit in one work cycle. In relation to the conventional manufacturing technique described above, which necessitated the deformation of the spark protection sleeve following the manufacturing step of introducing the jack contact into the spark protection sleeve, according to the invention, this deformation may be dispensed with. Therefore, one manufacturing step is saved in relation to the related art.

According to a preferred embodiment, a sawtooth profile is applied to the jack contact. Such a sawtooth profile is simple to manufacture, and is preferably fashioned as profiled sawtooth rings which extend helically around the jack contact forming a continuous winding. These sawtooth rings are compressed using regions of the inner surface of the spark protection sleeve during joining. This measure alone allows large tolerance variations in the internal diameter of the spark protection sleeve to be compensated in relation to corresponding tolerance variations in the external diameter of the jack contact.

The use of teeth and/or toothed rings having different tooth heights is particularly advantageous for compensating tolerance variations.

According to a further preferred embodiment, the jack contact is provided with a peripheral collar. Such a peripheral collar not only provides a tightly sealed termination of the spark protection sleeve in relation to the plug contact but also simplifies the procedure of joining the spark protection sleeve and the plug contact. It is particularly advantageous to provide this collar next to the sawtooth profile in relation to the central longitudinal axis of the jack contact. In this way, quality control during manufacturing is considerably simplified. Specifically, it is necessary to measure only, on the one hand, the compressive force applied during pressing and, on the other, the compression path traveled by the two pressed parts, namely the spark protection sleeve and the jack contact, in relation to one another, in order to compare the actual values with the predetermined setpoint values for both these parameters. If this comparison yields results within the predetermined tolerance variations, the jack is a good part. If not, it is a rejected part.

According to a further formulation of the invention, the contact part on the jack contact is embodied as a slotted hollow cylinder, so that individual contact lamellae form the jack contact. Preferably, at least one projection is fashioned onto the external surface of each contact lamella. If the jack contact is introduced into the spark protection sleeve, the projections on the outsides of the lamellae press against the inside surface of the spark protection sleeve and thus cause the contact lamellae to deform, i.e., deflect, inward, i.e., in the direction of the cavity formed between the contact lamellae. Due to this reversible bending of the contact lamellae inward, the lamellae have a defined pretension applied to them. Since the respective heights of the projections are equal, the contact lamellae always deform by the same amount, so that the contact lamellae are therefore identically deformed and thus identically pretensioned. The surfaces of the projections form a virtual circle, whose diameter, when the jack contact is inserted into the spark protection sleeve, corresponds to the internal diameter of the spark protection sleeve. As a result, all lamellae are bent the same distance inward, i.e., are deformed by the same amount in relation to the insertion opening of the spark protection sleeve, so that alignment errors are prevented.

It is particularly advantageous to form the projections by lathing an exterior ring onto the hollow cylinder forming the contact part, so that after the hollow cylinder is slotted, each lamella has a projection shaped like a segment of a circle on its outer surface. These projections, which are shaped like segments of a circle and extend over the entire width of the lamellae, have the advantage of a particularly large and uniform contact surface against the inner walls of the spark protection sleeve. This, in turn, has a positive influence on the deformation precision of the lamellae contacts.

Finally, the use of the projections has the further advantage that, their relative position—in relation to the central longitudinal axis—to the contact part on the jack contact offers a sliding scale for the pretension of the contact lamellae and therefore their spring characteristic. In other words, if the projections are placed at a large distance from the insertion opening of the jack contact, the remaining lever arm, and therefore also the spring travel, of the individual lamellae is very large. In contrast, if the projections are applied very close to the region of the insertion opening of the jack contact, the contact lamellae need yield only very slightly, and therefore have only a very small spring travel.

It is to be expressly noted that it is, of course, also conceivable and within the scope of the invention to provide the press fit claimed without the reversibly, elastically deformed contact lamellae and, vice versa, to combine the reversibly, elastically deformed contact lamellae with other arrangements for connecting the spark protection sleeve and the jack contact.

BRIEF DESCRIPTION OF THE DRAWINGS

The present invention is described in more detail with reference to the exemplary embodiments illustrated in the figures of the drawing, wherein.

DETAILED DESCRIPTION OF THE PREFERRED EMBODIMENTS

Figure 1:
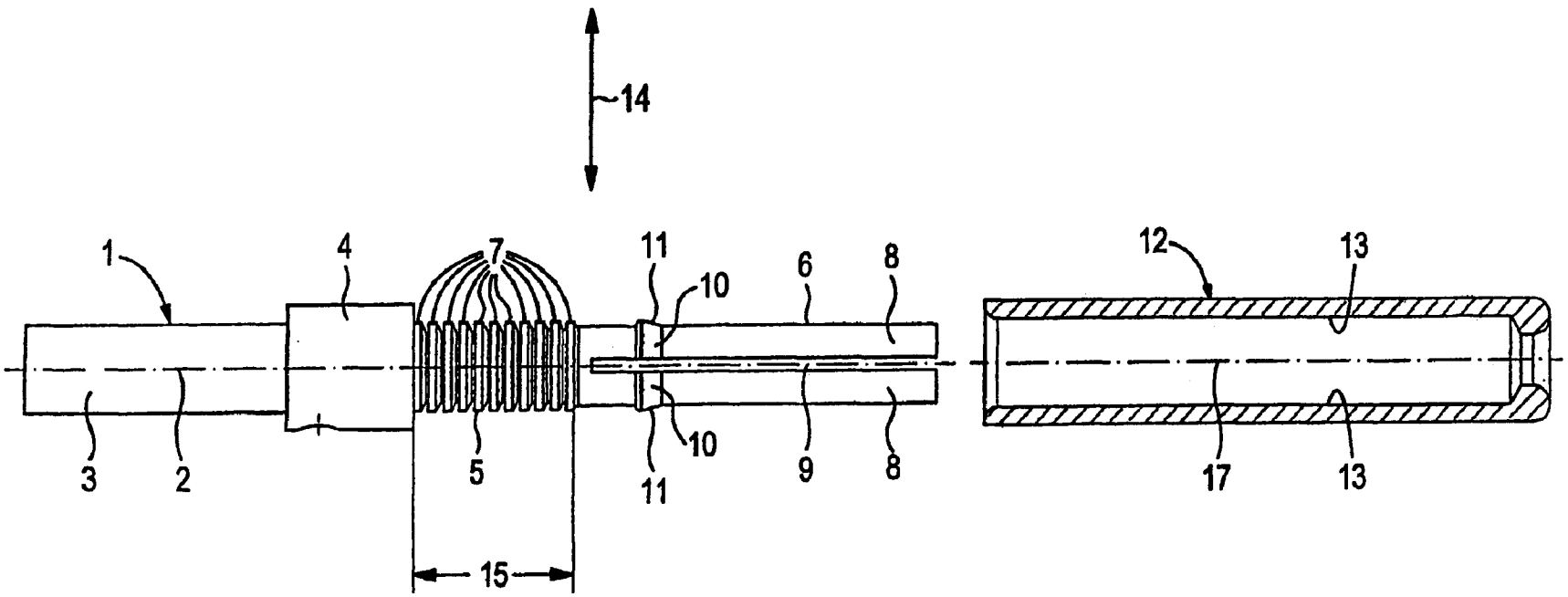
FIG. 1 shows an exploded view of a jack contact illustrated on the left in the figure of the drawing before being joined with a spark protection sleeve illustrated on the right in the drawing.

The jack contact 1 comprises four regions, viewed from left to right along its contact central longitudinal axis 2 in FIG. 1, namely a conductor insertion region 3, a peripheral collar 4, a sawtooth profile 5, and a contact part 6.

The sawtooth profile 5 is, in turn, produced from individual continuous sawtooth rings 7 positioned next to one another. The contact part 6 is originally a hollow cylinder and is slotted multiple times to form contact lamellae 8. In the exemplary embodiment, four slots 9 are slotted into the contact part 6. If the jack contact is inserted into the spark protection sleeve, the contact lamellae 8 deform, i.e., deflect, inward. Due to this reversible bending of the contact lamellae 8 inward, the lamellae have a defined pretension applied to them.

Figure 2:
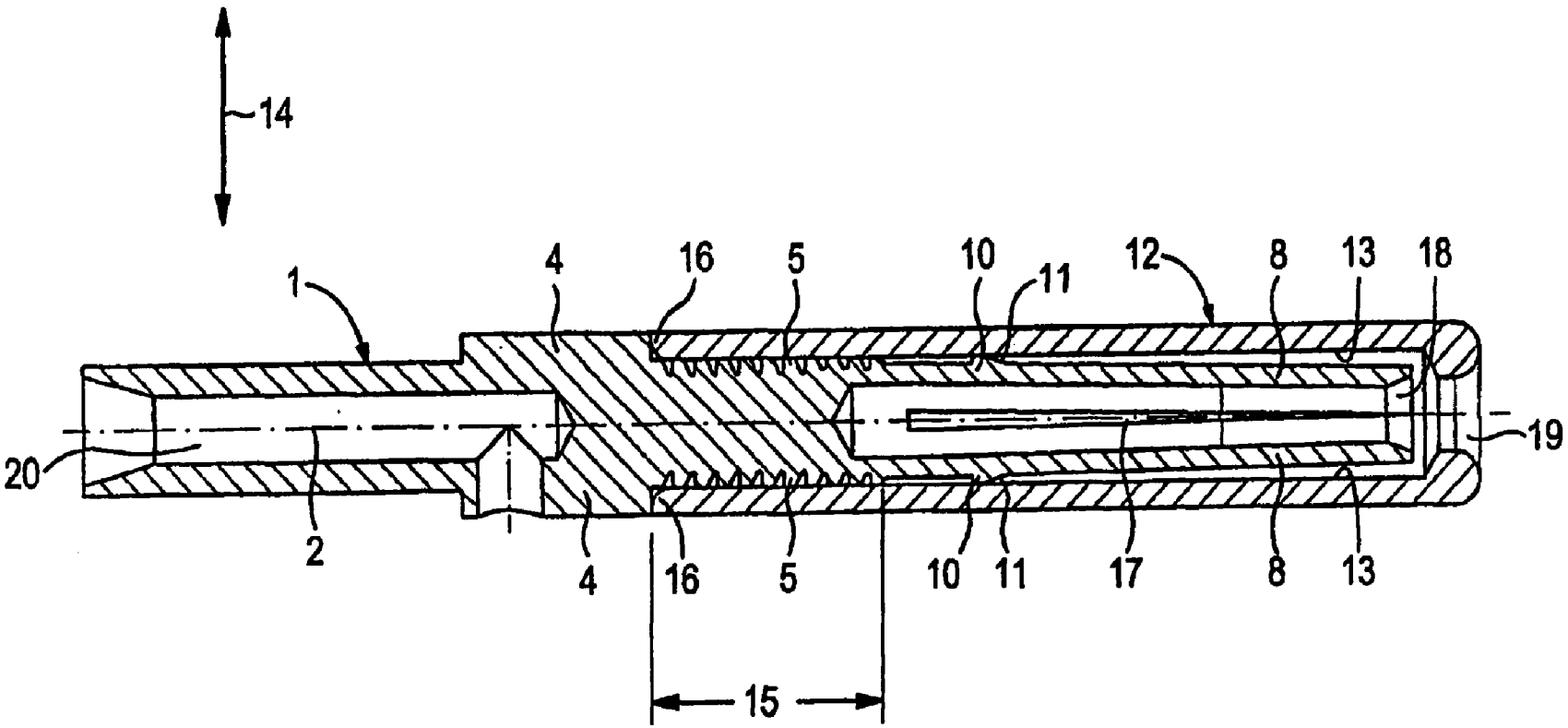
FIG. 2 shows, in section, a jack completely joined together and having the jack contact completely pressed into the spark protection sleeve.

Finally, projections 10, shaped like segments of a circle, are applied respectively to the outside of each contact lamella 8. Each projection 10 is slanted conically on its side facing away from the sawtooth profile 5, in order to form contact surfaces 11. In the final mounting state, the jack contact 1 is inserted into a spark protection sleeve 12, illustrated on the right of jack contact 1 in FIG. 1, and pressed together with it. During insertion, the contact surfaces 11 of the projections 10 engage with inner surfaces 13 of the spark protection sleeve 12 in such a way that contact lamellae 8 are bent toward one another in the transverse direction 14 running perpendicular to the contact central longitudinal axis 2. Therefore, in the final, assembled state, the contact surfaces 11 of the projections 10 partially press against inner surfaces 13 of the spark protection sleeve 12 and reversibly deform contact lamellae 8 toward one another in the transverse direction 14. The respective spring travel of the contact lamellae 8 may be selected, in effect, from a continuum, in accordance with the axial position selected for the projections 10. If the projections 10 in the exemplary embodiment shown in FIG. 1 and FIG. 2 are displaced further to the right along the contact central longitudinal axis 2, the effective lever arm of the contact lamellae 8 is reduced. The contact lamellae are then not able to spring as far as in an arrangement of the projections 10 near the sawtooth profile 7, as they are able to in the exemplary embodiment shown in FIG. 1 and FIG. 2.

As the jack contact 1 is inserted into the spark protection sleeve 12 and/or as the spark protection sleeve 12 is pushed onto the jack contact 1, the sawtooth profile 5 also engages with the inner surface 13 of the spark protection sleeve 12. A compressive force is then applied to the jack contact in such a way that individual sawtooth rings 7 of the sawtooth profile 5 deform to produce a press fit with the sleeve 12.

To ensure high production quality, the path corresponding to the profile length 15 of the sawtooth profile is measured until the ends 16 of the spark protection sleeve strike against the collar 4. If these two values are within the predetermined tolerance range, the piece is determined to be a good part.

With the aid of the sawtooth profile 5, particularly the use of sawtooth rings 7 of various heights, as described in greater detail hereinbelow, it is possible to cover a large field of tolerance between the spark protection sleeves 12 and the jack contacts 1. It is also conceivable to use the same type of spark protection sleeve 12 for multiple different jack contacts 1.

Finally, it may be seen in FIG. 2 that in the final mounting position, i.e., the assembled state, the contact central longitudinal axis 2 and the sleeve central longitudinal axis 17 align exactly with one another and thus form a shared jack contact central longitudinal axis.

It may also be seen in FIG. 2 that a contact part opening 18 formed by the contact lamellae 8 on the end aligns exactly with an insertion opening 19 of the spark protection sleeve 12. This is advantageous when the plug pin of the counterplug is inserted into the jack contact. It is particularly important to avoid alignment errors in this case, because typically jack contacts 1 are arranged in a whole row next to one another, onto which a contact plug having multiple plug pins arranged next one another is plugged. These plug pins are frequently positioned on parts having a high weight, so that the insertion may not be performed sensitively, but rather in such a manner that strong and abrupt forces act on the jack.

Finally, FIG. 2 also shows a terminal opening 20 for a conductor, not shown in the drawing, for making electrical contact with the jack, composed essentially of the jack contact 1 and the contact sleeve 12.

Figure 3:
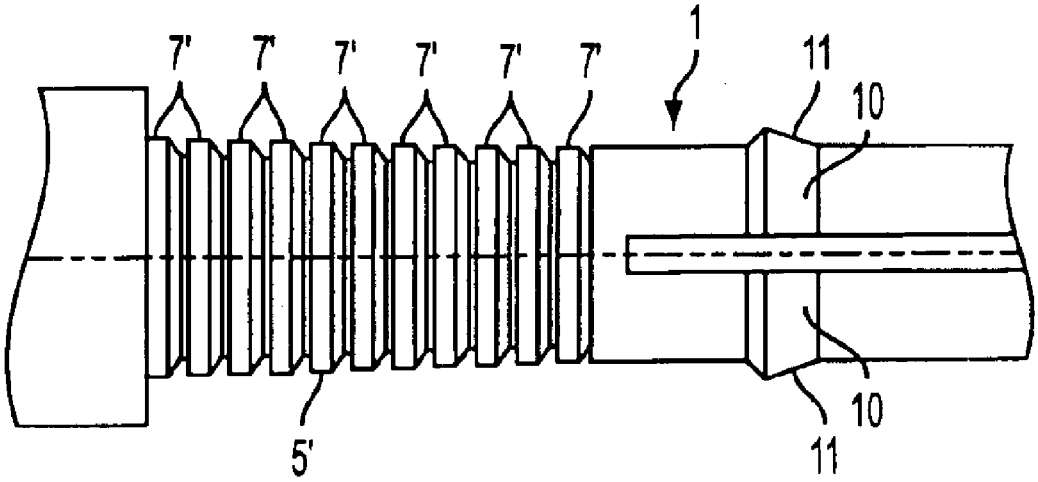
FIG. 3 shows, in enlarged detail, an alternative embodiment of a jack contact.

FIG. 3 shows an—in relation to FIG. 1—enlarged detail of a jack contact according to an alternative embodiment. Unlike the embodiment of FIG. 1, where the sawtooth rings 7 have the same tooth height, i.e. have the same diameter, the saw teeth 7' form a sawtooth profile 5' that is conical. In particular, the tooth height of respectively successive sawtooth rings decreases, preferably gradually and uniformly, in the direction of the projections 10. This embodiment facilitates insertion of the jack contact into the spark protection sleeve 12 and provides further flexibility in absorbing manufacturing tolerances.

Figure 4:
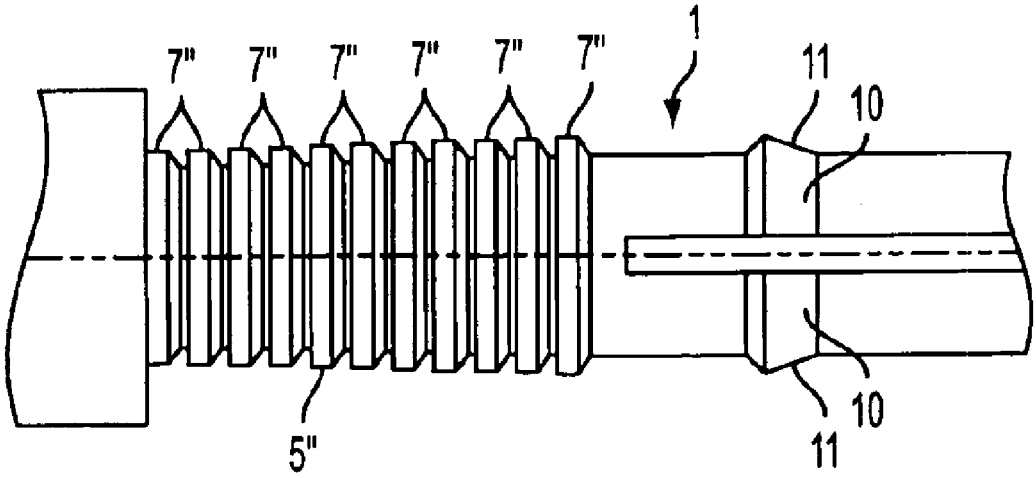
FIG. 4 shows, again in enlarged detail, another embodiment of a jack contact.

According to yet another alternative embodiment of the jack contact, illustrated in FIG. 4, the sawtooth profile 5" is again conical. However, contrary to the embodiment of FIG. 3, the tooth height of the successive sawtooth rings 7" increases with axial proximity to the projections 10.

Figure 5:
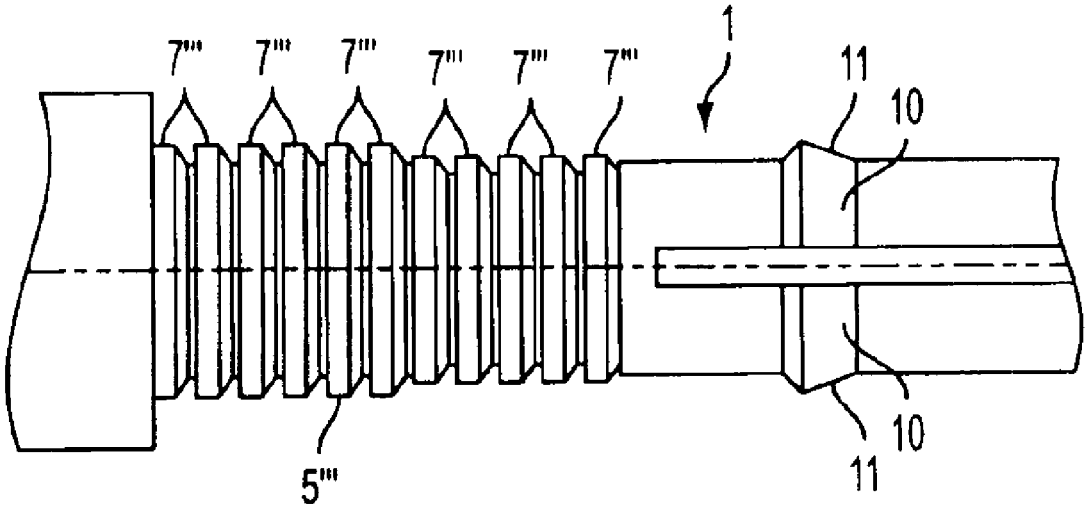
FIG. 5 shows, again in enlarged detail, yet another embodiment of a jack contact.

FIG. 5 illustrates a further alternative embodiment of the jack contact, which again differs from the previously disclosed embodiments in the details of the sawtooth profile 5'''. Here, the tooth height varies discontinuously along the length of the sawtooth profile 5'''. According to the specific design shown, the sawtooth profile 5''' varies stepwise, in particular in that the five sawtooth rings 7''' closest to the projections 10 have a first tooth height that is less than a second tooth height of the six sawtooth rings 7''' that are further removed from the projections 10.

The above description of the preferred embodiments has been given by way of example. From the disclosure given, those skilled in the art will not only understand the present invention and its attendant advantages, but will also find apparent various changes and modifications to the structures and methods disclosed. It is sought, therefore, to cover all such changes and modifications as fall within the spirit and scope of the invention, as defined by the appended claims, and equivalents thereof.

What is claimed is:

1. A jack for a plug-jack combination, comprising:

a spark protection sleeve, and a jack contact fixed in the spark protection sleeve and comprising a reversibly deformed contact part, wherein a press fit fixes the jack contact in the spark protection sleeve and reversibly deforms the contact part, wherein the jack contact further comprises a sawtooth profile having saw teeth, and wherein the saw teeth forming the sawtooth profile vary in tooth height.

2. The jack according to claim 1, wherein the saw teeth are continuous along the sawtooth profile and are partially deformed in the pressed-in state of the jack contact.

3. The jack according to claim 1, wherein the jack contact further comprises a peripheral collar as a stop for the jack contact as the jack contact is inserted into the spark protection sleeve.

4. The jack according to claim 1, wherein the press fit fixes the jack contact by wedging the jack contact into the spark protection sleeve.

5. The jack according to claim 1, wherein the jack contact has a longitudinal contact axis and is configured and dimensioned to insert into the spark protection sleeve and to deflect elastically towards the longitudinal contact axis during the insertion.

6. The jack according to claim 1, wherein the contact part comprises plural contact lamellae having a spring characteristic and elastically pressed by said spark protection sleeve into a volume that is smaller than a volume occupied by said lamellae when said lamellae are not elastically pressed.

7. The jack according to claim 1, wherein the contact part comprises plural contact lamellae.

8. The jack according to claim 7, wherein the contact part further comprises plural projections on respective outer surfaces of the contact lamellae.

9. The jack according to claim 8, wherein the contact lamellae are formed by slots in a hollow cylinder.

10. The jack according to claim 9, wherein the projections are shaped as segments of a circle and are formed by an exterior ring lathed onto the hollow cylinder.

11. The jack according to claim 7, wherein the contact lamellae are formed by slots in a hollow cylinder.

12. A jack for a plug-jack combination, comprising:

a spark protection sleeve, and a jack contact fixed in the spark protection sleeve and comprising a reversibly deformed contact part, wherein a press fit fixes the jack contact in the spark protection sleeve and reversibly deforms the contact part, wherein:

the jack contact further comprises a sawtooth profile having saw teeth, the jack contact further comprises a peripheral collar as a stop for the jack contact as the jack contact is inserted into the spark protection sleeve, and the collar and the sawtooth profile are positioned directly next one another in relation to a central longitudinal axis of the jack contact.

13. The jack according to claim 12, wherein the contact part comprises plural contact lamellae.

14. The jack according to claim 13, wherein the contact part further comprises plural projections on respective outer surfaces of the contact lamellae.

15. The jack according to claim 14, wherein the contact lamellae are formed by slots in a hollow cylinder.

16. The jack according to claim 15, wherein the projections are shaped as segments of a circle and are formed by an exterior ring lathed onto the hollow cylinder.

17. The jack according to claim 13, wherein the contact lamellae are formed by slots in a hollow cylinder.

18. A jack for a plug pin, comprising:

a spark protection sleeve; and a jack contact inserted in said sleeve;

wherein said jack contact comprises means for securing said sleeve to said jack contact with an elastic, pretensioned press-fit, wherein said means comprise lamellae having a spring characteristic and elastically pressed by said spark protection sleeve into a volume that is smaller than a volume occupied by said lamellae when said lamellae are not elastically pressed, and wherein said means further comprise projections interposed between said lamellae and said spark protection sleeve.

19. The jack according to claim 18, wherein said means further comprise projections elastically pressed by said spark protection sleeve.

20. A jack for a plug-jack combination, comprising:

a spark protection sleeve, and a jack contact fixed in the spark protection sleeve and comprising a reversibly deformed contact part;

wherein the jack contact further comprises a sawtooth profile having saw teeth, and the saw teeth forming the sawtooth profile vary in tooth height.

21. A jack for a plug-jack combination, comprising:

a spark protection sleeve, and a jack contact fixed in the spark protection sleeve and comprising a reversibly deformed contact part, a peripheral collar as a stop for the jack contact as the jack contact is inserted into the spark protection sleeve, and a sawtooth profile having saw teeth, wherein the collar and the sawtooth profile are positioned directly next one another in relation to a central longitudinal axis of the jack contact.

22. A jack for a plug pin, comprising:

a spark protection sleeve;

a jack contact inserted in said sleeve; and means for securing said sleeve to said jack contact with an elastic, pretensioned press-fit, wherein said means comprise lamellae having a spring characteristic and elastically pressed by said spark protection sleeve into a volume that is smaller than a volume occupied by said lamellae when said lamellae are not elastically pressed, and wherein said means comprise projections interposed between said lamellae and said spark protection sleeve.

* * * * *